US005414965A

United States Patent [19]

Kelley et al.

[11] Patent Number: 5,414,965

[45] Date of Patent: * May 16, 1995

[54] ROOF EDGE ANCHORING DEVICES FOR BUILDING STRUCTURES

[75] Inventors: Tommy D. Kelley; Mark D. Braine, both of Asheville; Gregory Henson, Canton; John B. Hickman; Ralph Kirby, both of Asheville; William C. Roberts, Weaverville; Kevin D. Rogers, Swannanoa, all of N.C.

[73] Assignee: W. P. Hickman Company, Asheville, N.C.

[ * ] Notice: The portion of the term of this patent subsequent to Oct. 12, 2010 has been disclaimed.

[21] Appl. No.: 115,434

[22] Filed: Sep. 1, 1993

Related U.S. Application Data

[62] Division of Ser. No. 868,948, Apr. 15, 1992, Pat. No. 5,251,411.

[51] Int. Cl.[6] ..... E04D 1/36

[52] U.S. Cl. ..... 52/60; 52/94

[58] Field of Search ..... 52/408, 411; 56/60, 56/94

[56] References Cited

U.S. PATENT DOCUMENTS

| | | | |
|---|---|---|---|
| Re. 26,056 | 7/1966 | Hickman . | |
| 1,337,840 | 4/1920 | Hawley . | |
| 1,782,246 | 11/1930 | Schneider . | |
| 2,554,779 | 5/1951 | Goodwin . | |
| 2,857,861 | 10/1958 | Trostle . | |
| 3,086,324 | 4/1963 | Cheney . | |
| 3,100,951 | 8/1963 | Hickman . | |
| 3,187,464 | 6/1965 | Sharp . | |
| 3,199,256 | 8/1965 | Considder . | |
| 3,389,515 | 6/1968 | Hellebrand . | |
| 3,415,020 | 12/1968 | Windle . | |
| 3,432,976 | 3/1969 | Berg . | |
| 3,585,766 | 6/1971 | Jamieson . | |
| 3,719,010 | 3/1973 | Hickman . | |
| 4,071,987 | 2/1978 | Hickman . | |
| 4,231,141 | 11/1980 | Derrick et al. . | |
| 4,472,913 | 9/1984 | Hickman . | |
| 4,488,384 | 12/1984 | Hickman . | |
| 4,549,376 | 10/1985 | Hickman . | |
| 4,586,301 | 5/1986 | Hickman . | |
| 4,598,507 | 7/1986 | Hickman . | |
| 4,617,770 | 10/1986 | Hickman . | |
| 4,641,476 | 2/1987 | Webb et al. . | |
| 4,662,129 | 5/1987 | Hickman . | |
| 4,759,157 | 7/1988 | Webb et al. . | |
| 4,780,999 | 11/1988 | Webb et al. . | |
| 4,873,807 | 10/1989 | Filip | 52/408 |
| 4,890,426 | 1/1990 | Hickman et al. . | |
| 4,909,006 | 3/1990 | Hickman et al. . | |
| 4,912,888 | 4/1990 | Martin | 52/11 X |
| 4,964,248 | 10/1990 | Braine et al. . | |
| 4,977,720 | 12/1990 | Kuipers | 52/408 |
| 4,987,714 | 1/1991 | Lemke | 52/410 |

*Primary Examiner*—Carl D. Friedman
*Assistant Examiner*—Creighton Smith
*Attorney, Agent, or Firm*—Harness, Dickey & Pierce

[57] ABSTRACT

An assembly is provided for sealingly anchoring a sheet-like base roofing material on a building structure. The assembly includes an anchoring flange or plate having a number of openings therethrough, and a marshal strip of sheet martial overlies the anchoring flange and is bonded directly to the base roofing material through the openings, and preferably at a location interior of the anchoring flange. The assembly an be used in roof edge installations, for example, and can also include a fascia or a gutter arrangement, or a wide variety of other conjurations to suit a given application.

21 Claims, 7 Drawing Sheets

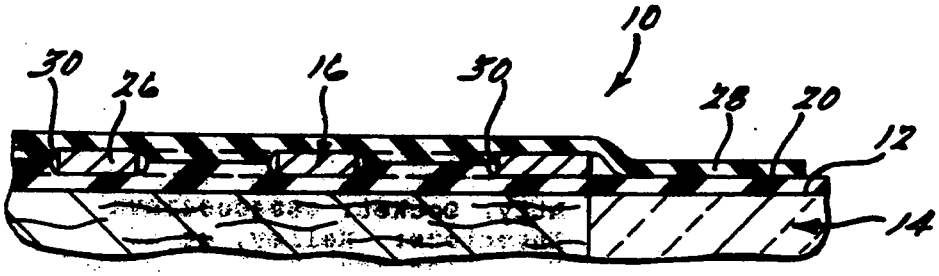
FIG. 3.
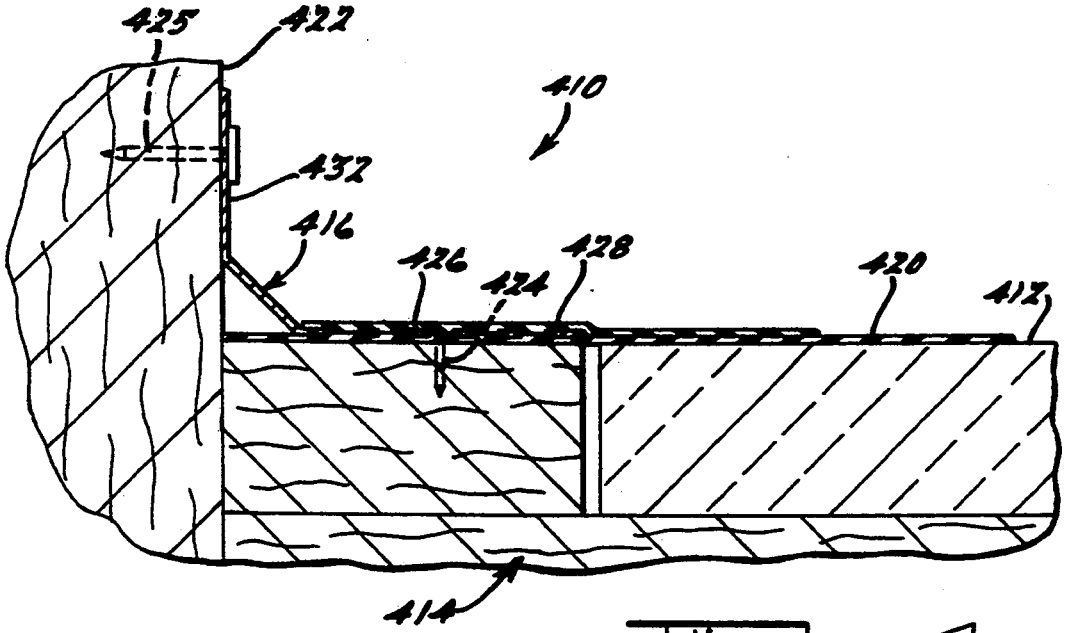
FIG. 4.
FIG. 5.
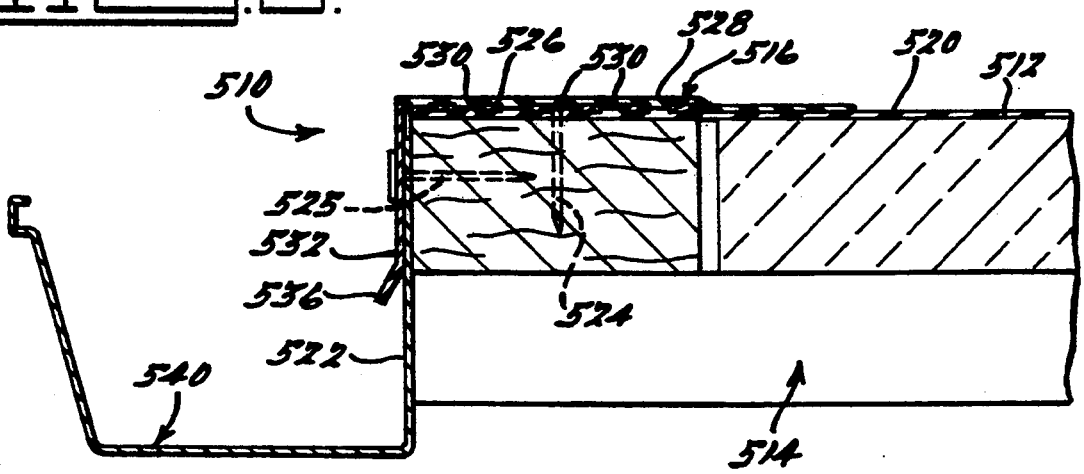

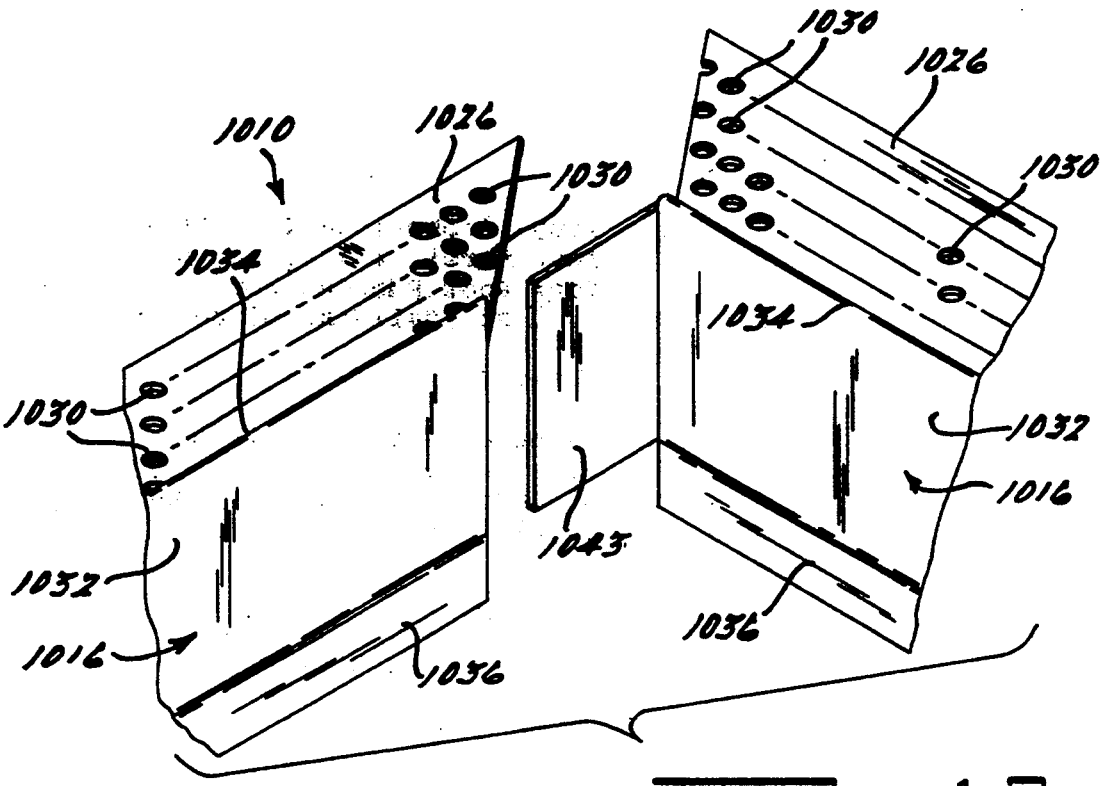
FIG. 12.
FIG. 13.
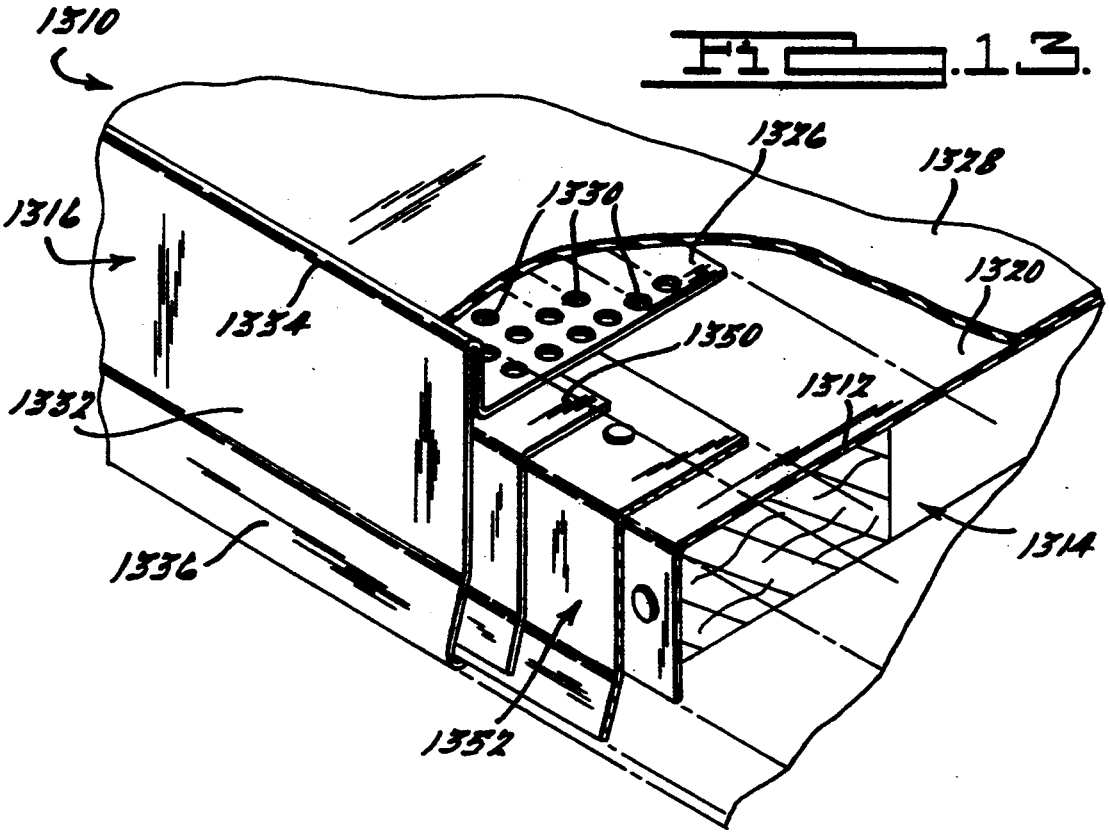

ROOF EDGE ANCHORING DEVICES FOR BUILDING STRUCTURES

This is a division of United States patent application Ser. No. 07/868,948, filed Apr. 15, 1992, now U.S. Pat. No. 5,251,411.

BACKGROUND AND SUMMARY OF THE INVENTION

The invention relates generally to building structures and more particularly to edge constructions for such building structures, wherein an edge sealing assembly serves to sealingly anchor and clamp a sheet-like membrane or roofing material along the edge of the building structure or along a stepped configuration formed by an adjacent back wall, for example. Such anchoring is necessary in order to avoid uplift effects of wind or other elements, which could tend to tear the roofing material off the roof. Many manufacturers of such roofing materials require the roofing material to be brought to or beyond the edge of the roof and secured in place with nails or other fasteners or adhesives. If a roof edge, gravel stop or cant assembly is to be used, such assembly is generally required to be applied over the roofing material, and a second layer of roofing material, in the form of a marginal strip is applied over at least a portion of the gravel stop, with such marginal strip generally being about six to eighteen inches in width.

Various edge sealing constructions, copings, raised roof edge assemblies, gravel stop assemblies, water dams, and the like, have been provided for purposes of sealing upper edges of construction components, anchoring sheet-like roofing or sealing membranes, retaining gravel ballasts or other building materials, controlling water drainage, or for supporting fascia members at the edge of the roof of a building structure, for example. Examples of such previously-provided assemblies are disclosed in U.S. Pat. Nos. 3,719,010; RE 26,056; 4,071,987; 4,472,931; 4,488,384; 4,549,376; 4,586,301; 4,598,507; 4,617,770; 4,641,476; 4,662,129; 4,759,157; 4,780,999; 4,890,426; 4,909,006; and 4,964,248, as well as, the prior art references cited therein, with all of the above-mentioned patents being owned by the same assignee as the present invention. The disclosures of all of these patents are thus hereby incorporated herein by reference.

The edge sealing assemblies disclosed in the above-referenced patents represent great strides over previous edge constructions in terms of stability, simplicity, cost-effectiveness, ease of installation, flexibility of application, and effectiveness in anchoring membranes. But the desire for even further improvements, however, has led to the development of the present invention, which overcomes the problem of roofing materials delaminating or otherwise becoming detached from the roof edge, gravel stop, or cant assembly.

In accordance with these objectives, the present invention provides an assembly for forming a roof edge assembly or other roofing assembly on a building structure, wherein the assembly includes a perforated anchoring flange that is installed over the sheet-like roofing material, with a marginal strip of similar sheet-like roofing material, or another compatible membrane extending over the perforated anchoring flange and overlapping a portion of the lower layer of roofing material, which extends under the perforated anchoring flange.

In this inventive installation, the upper marginal strip can be adhered, through the openings in the perforated anchoring flange, directly to the underlying base sheet of roofing material, either by the use of suitable adhesives or by fusion techniques, such as by heat-welding, solvent-welding, or other fusion methods suitable for the materials being used.

The invention can be applied in any of a wide variety of roof edge or other such configurations, including raised roof edges, gravel stops, drain edge or gutter assemblies, firestop-cant assemblies, or other configurations.

Additional objects, advantages, and features of the present invention will become apparent from the following description and appended claims, taken in conjunction with the accompanying drawings.

BRIEF DESCRIPTION OF THE DRAWINGS

FIG. 3 is an enlarged view of a portion of the cross-sectional view of FIG. 2, illustrating the adherence of the upper marginal strip to the lower, base roofing material, through the perforations in the anchoring flange.

FIG. 4 is a cross-sectional view similar to that of FIG. 2, but illustrating an alternate embodiment of the invention, as applied in a fire-stop and cant installation.

FIG. 5 is a cross-sectional view similar to that of FIG. 2, but illustrating an alternate embodiment of the invention, as applied in a drain edge and gutter assembly.

FIG. 12 is a view similar to that of FIG. 11, but illustrating an inside corner configuration therefor.

FIG. 13 illustrates a further alternate embodiment of the present invention, shown partially in perspective and partially in cross-section, including splicer members at the joints between adjacent fascia members having an anchoring flange incorporated thereon, and further including a substantially continuous clip on which the hooked lower drip edge of the fascia member is interlockingly engaged.

DETAILED DESCRIPTION OF THE PREFERRED EMBODIMENTS

Figure 1:
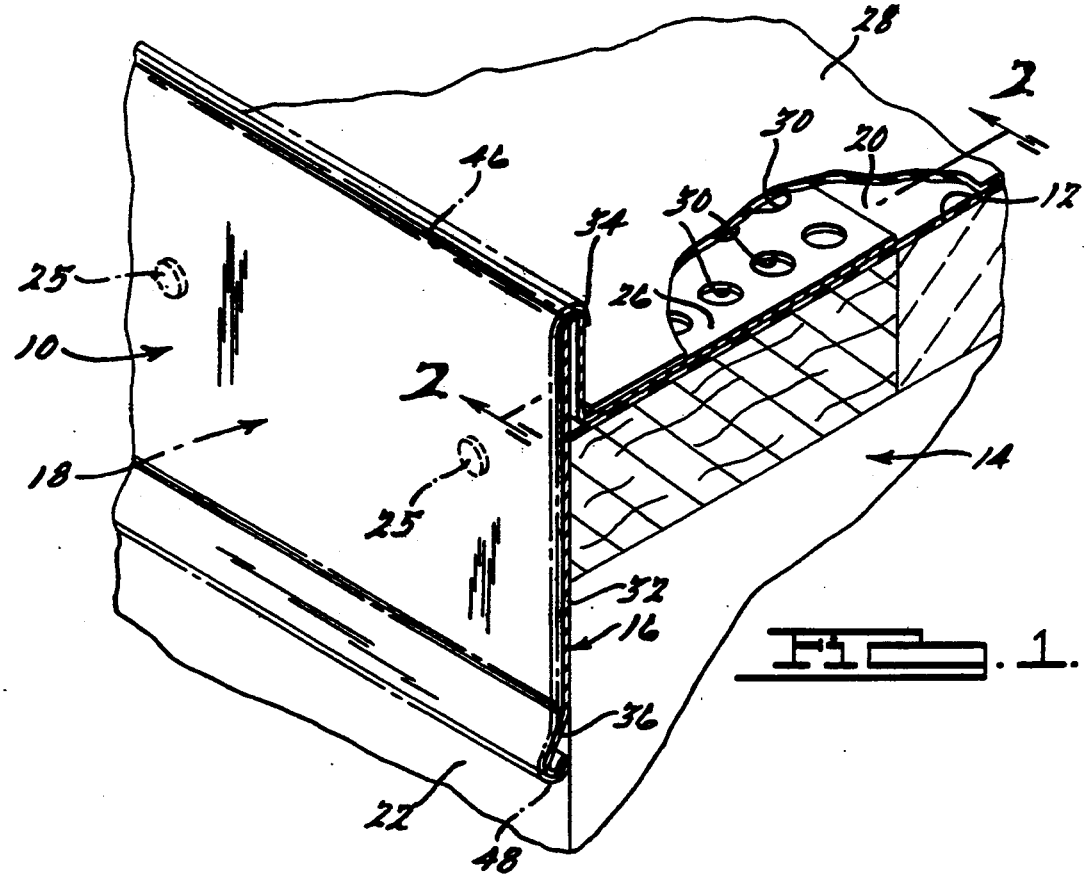
FIG. 1 is a partial perspective view, shown partially in cross-section, of one of the preferred exemplary embodiments of a roof edge assembly.

FIGS. 1 through 20 illustrate various exemplary embodiments of an assembly for forming a roof edge or other roof structure assemblies on a building structure in accordance with the present invention, provided for purposes of sealingly anchoring a sheet-like roofing material. It should be noted, however, that such invention is applicable in building construction configurations other than those shown for purposes of illustration in the drawings, as well as in other applications for sealing or anchoring other roofing materials in building constructions.

Figure 2:
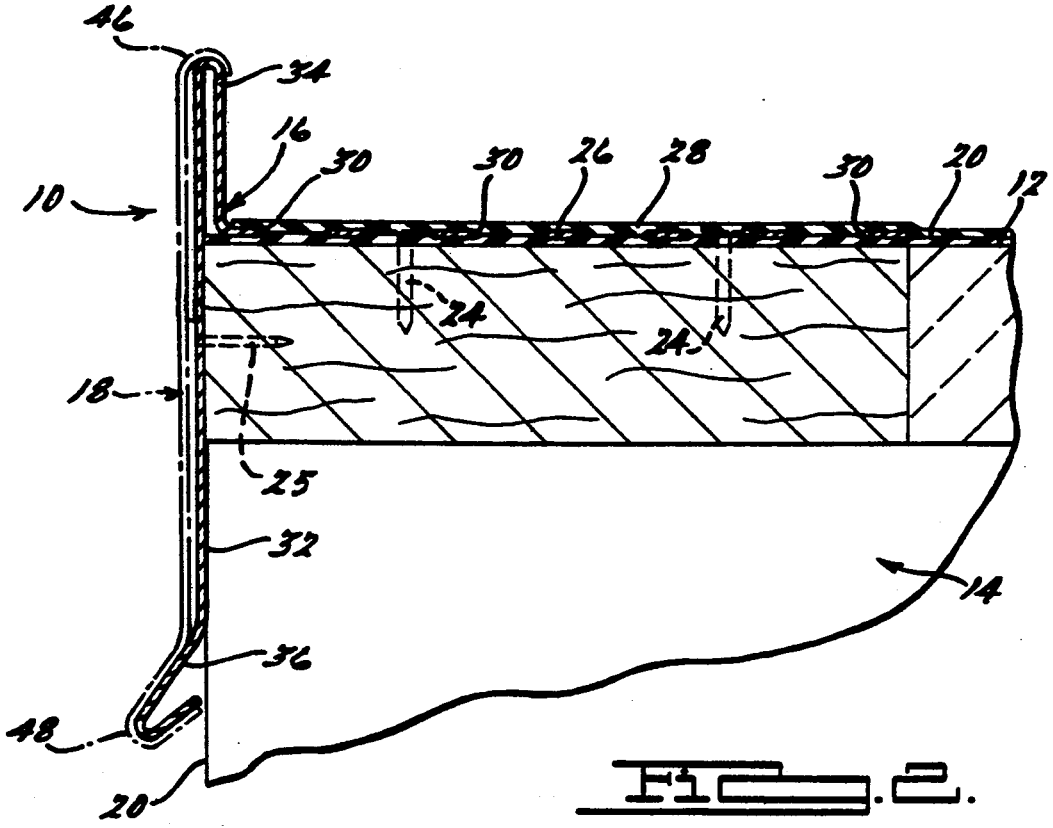
FIG. 2 is a cross-sectional view of the exemplary roof edge assembly of FIG. 1, taken generally along line 2—2 of FIG. 1.

In FIGS. 1 through 3, a preferred roof edge assembly 10 for forming a roof edge on a horizontal roof surface 12 of a building structure 14 generally includes an anchoring member 16 and an optional fascia member 18 assembled for sealingly anchoring a base sheet-like roofing material 20 extending along the horizontal roof surface 12, with the assembly 10 overlapping the vertical face 22 of the building structure 14.

The anchoring member 16 includes an anchoring flange 26 extending generally horizontally over the horizontal roof surface 14 and the base roofing material 20, and the anchoring flange 26 is preferably attached to the horizontal surface 12 of the building structure 14 by way of suitable fasteners 24, which can be threaded fasteners, nails, or other suitable fasteners known to those skilled in the art. Optionally, the anchoring member 16 can also be attached to the vertical face 22 by way of similar fasteners 25, although this alternate attachment might not be necessary in all installations, such as when the optional fascia member 18 is deleted from the illustrated assembly in order to form a simple drip edge, but still sealingly anchor the base roofing material 20.

The anchoring flange 26 has a number of perforations or openings 30 formed therein, and a marginal strip 28 is placed over the anchoring flange 26 and the fasteners 24, and overlaps an interior portion of the base roofing material 20. The marginal strip can be another piece of roofing material similar to the base roofing material 20 or any other suitable, leakproof sheet material that can be bonded directly to the base roofing material 20 by an adhesive through the openings 30 in the anchoring flange 26 and at the interior portion where the marginal strip 28 overlaps the base roofing material 20 directly. Such bonding can also be accomplished by way of heat-welding where materials suitable for such a process are used, such as PVC or PVC-based sheet materials, or bitumenous sheet materials, for example.

By such a construction according to the invention, the base roofing material 20 is securely anchored at the roof edge, and sealed by way of the above-mentioned bonding or adhering of the marginal strip 28 to the base roofing material 20, thus effectively eliminating wind tearing or other forces tending to rip up the base roofing material 20. Also, the invention allows such secure, sealing anchoring of the base roofing material to be accomplished quickly, conveniently and easily during construction.

The anchoring member 16 shown in FIGS. 1 through 3 is of a generally L-shaped cross-sectional configuration, which is defined by the generally horizontal anchoring flange 26 and a generally vertical leg portion 32. The anchoring member 16 includes a raised upper edge portion 34, which can extend generally vertically, as shown, or which can slope generally upwardly and outwardly from the anchoring flange 26 (not shown), as well as a downwardly and outwardly sloping lower edge portion 36, with such upper and lower edge portions being employed for retaining the fascia member 18 in a snapped-on relationship therewith.

The fascia member 18 also includes a generally hooked upper edge portion 46 thereon, with a similar hooked lower drip edge portion 48 being disposed at the lower end of the generally vertical lower portion 42.

Thus, when the clamping member 16 is fixedly secured to the building structure 14, the fascia member 18 can be installed on the clamping member 16, both of which are preferably formed of a relatively resilient material, by hooking the hooked lower edge 48 of the fascia member 18 onto the lower edge portion 36 of the clamping member 16, and then snapping the hooked upper edge portion 46 of the fascia member 18 over the upper edge portion 26 of the clamping member 16.

Alternately, if desired or required in a given installation, although not explicitly illustrated in the drawings, a plain anchoring member, consisting of only a flat perforated plate, can be provided to anchor the base roofing material 20 in place, sealingly bonded or adhered to the marginal strip 28. In such an installation, however, some other form of roof edge or fascia assembly may be desired or required to finish off the edge of the roof. This would, however, allow the advantages of the invention to be realized, in suitable applications which will occur to those skilled in the art, in conjunction with other roof edge assemblies or other building structure components not having the anchoring flange 26.

The remaining figures illustrate other applications of the principles of the invention, with components or elements in each of these figures that are similar to, or that correspond to, components or elements of FIGS. 1 through 3 being indicated by similar or corresponding reference numerals, but having four-hundred prefixes through two-thousand prefixes, corresponding to the figure numbers for FIGS. 4 through 20, respectively.

As illustrated in FIG. 4, the exemplary invention of FIGS. 1 through 3 can be modified for other installations. The firestop-cant assembly 410 includes an anchoring member 416 that is formed in the shape of a firestop-cant member.

Frequently, whenever flame or heat is needed in the assembly of a component or sub-assembly in an application such as the one in FIG. 4, wherein a wall having a face 422 intersects a roof surface 412, a piece of flame-proof fiber, or other fire-proof material is used to prevent the heat and flame from shooting down any gap between the back wall and the adjacent roof, thus creating a fire hazard. The anchor member 416 includes a generally vertical portion 432, which is integral with the anchor flange 426, thus creating the same sealing anchoring of the base material 420 with the bonding to the marginal strip 428, while at the same time sealing the gap and acting as a firestop during heat-welding upon installation.

In FIG. 5, an anchoring member 516 is provided and arranged to cooperate with a gutter member 540, directing run-off from the roof into the gutter.

Figure 6:
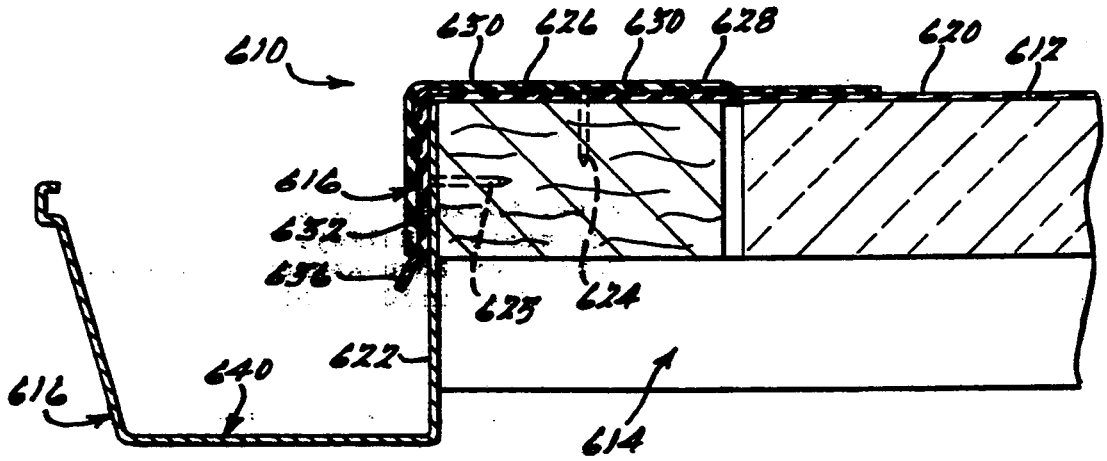
FIG. 6 is a cross-sectional view similar to that of FIG. 2, but illustrating an alternate embodiment of the invention, as applied in another drain edge and gutter assembly.

FIG. 6 illustrates an application similar to that of FIG. 5, except that the base roofing material 620 extends over the edge of the roof structure to extend down the vertical face of the anchoring flange's vertical leg portion 632, and the vertical leg portion 632 also has openings 630 therein for allowing the base roofing material 620 to be bonded to the marginal strip 628, which correspondingly extends vertically along the vertical face.

Figure 7:
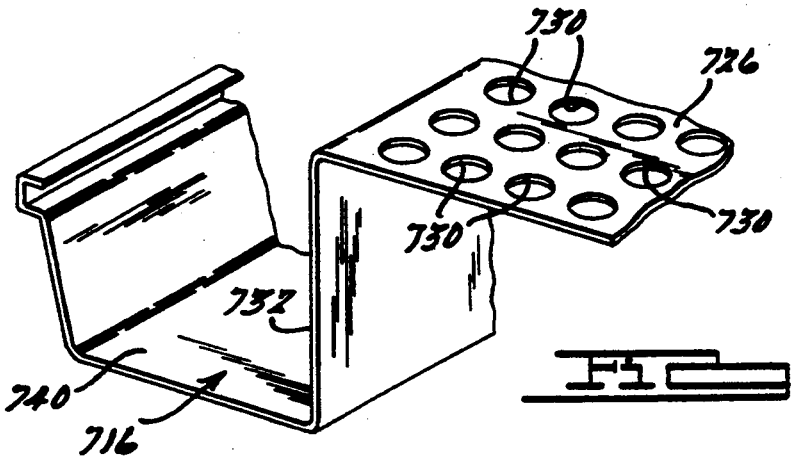
FIG. 7 is a partial perspective view of a one-piece flange-and-gutter member according to the present invention, representing a variation on the application of FIG. 6.

In FIG. 7, an anchoring member 716 includes an integral gutter portion 640. In other respects, however, the one-piece gutter-and-anchoring member 716 is substantially similar in configuration and function as the assembly in FIGS. 5 and 6.

Figure 8:
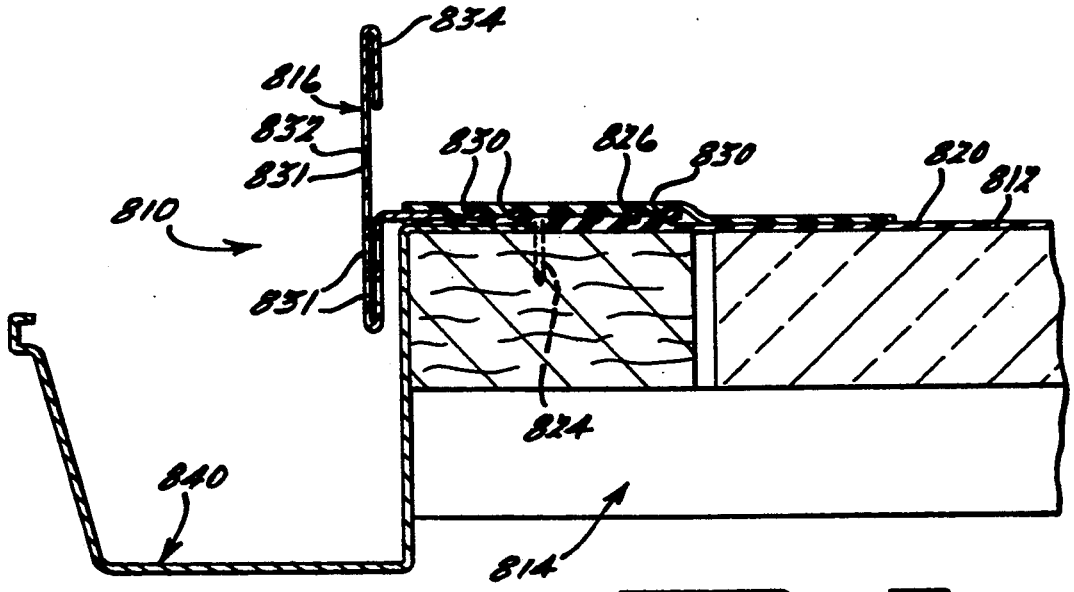
FIG. 8 is a cross-sectional view of an embodiment similar to that shown in FIG. 6, but illustrating a variation wherein a raised roof edge is incorporated into a drain edge and gutter assembly.

FIG. 8 is similar to many of the preceding figures, except that the anchoring member 816 includes a raised vertical leg portion 832 that serves to direct run-off into a separate gutter member 840.

Figure 9:
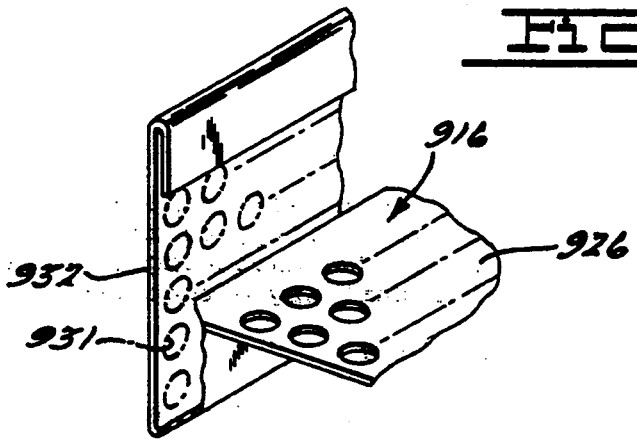
FIG. 9 is a partial perspective view of a raised roof edge member, similar to that of FIG. 8, but having a series of openings or perforations in the vertical portion thereof, with such openings being provided for purposes of water drainage.

The anchoring member 816 of FIG. 8 can also be modified, as shown in FIG. 9, by providing a series of openings or perforations 931 in the vertical leg portion 932, thereby providing for enhanced drainage of run-off, through the openings 931, into the gutter member 940.

Figure 10:
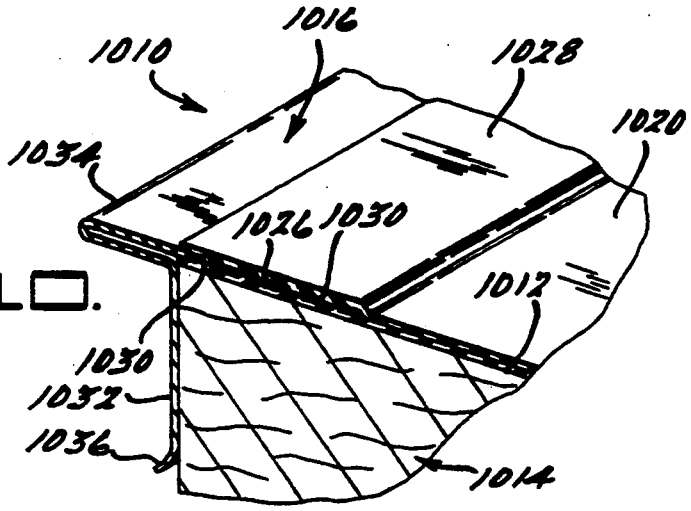
FIG. 10 is a partial perspective view, shown partially in cross-section, illustrating an application of the invention having a generally horizontal lip forming the roof edge structure and having an outwardly and downwardly sloping drip edge.
Figure 11:
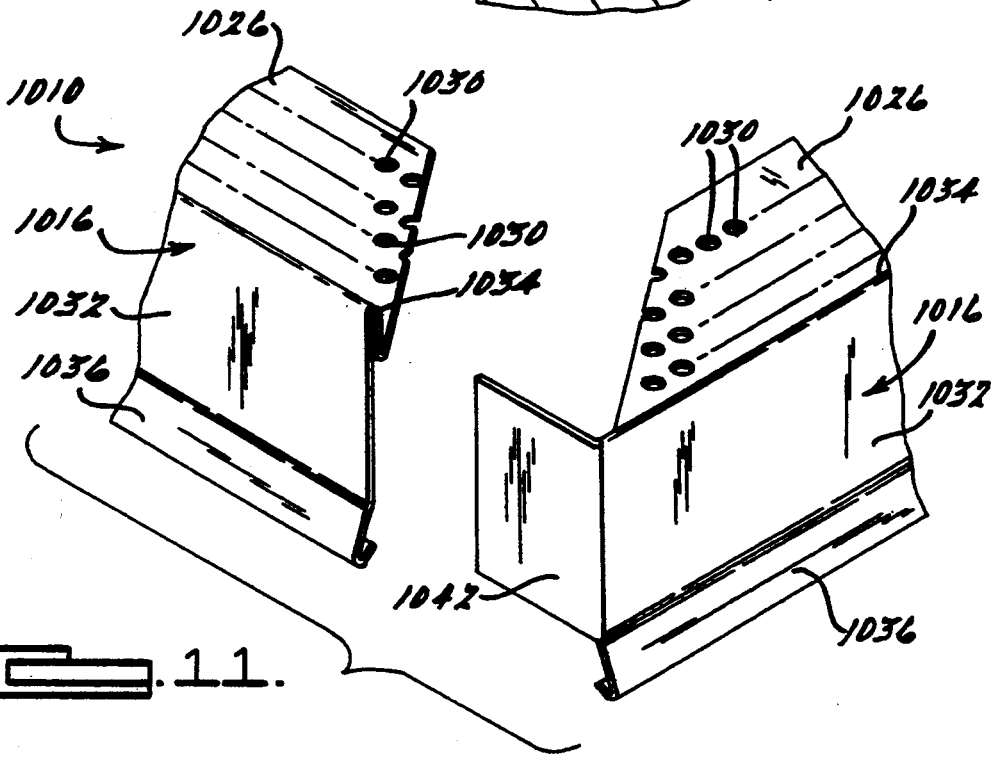
FIG. 11 illustrates the alternate variation of FIG. 10, but shows a mitered outside corner configuration therefor.
Figure 14:
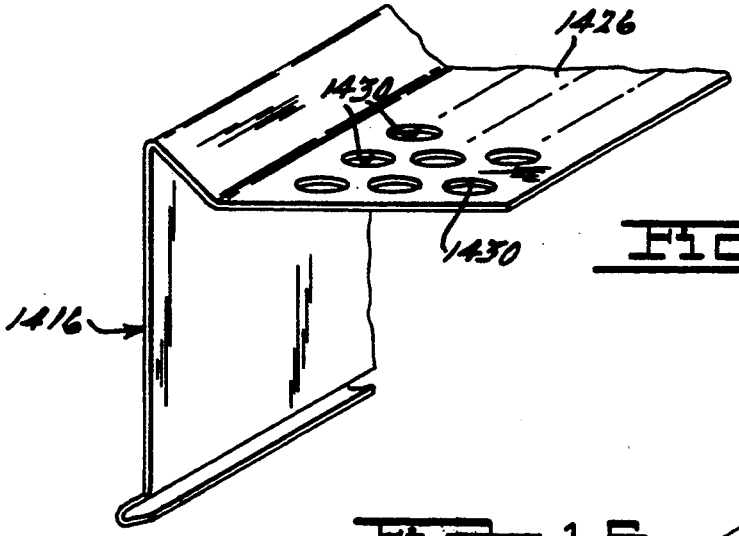
FIGS. 14 through 19 illustrate various alternate configurations of the fascia member of FIG. 13, with a number of the exemplary varieties of perforation sizes, shapes, arrangements and configurations being shown, such examples also being applicable in the anchoring flanges of any of the other embodiments of the invention.
Figure 15:
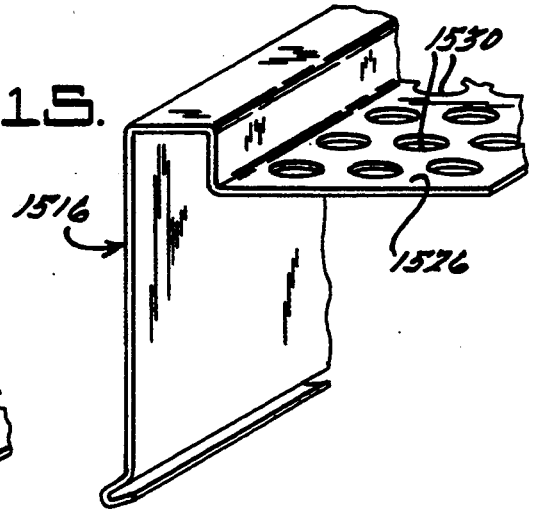
Figure 16:
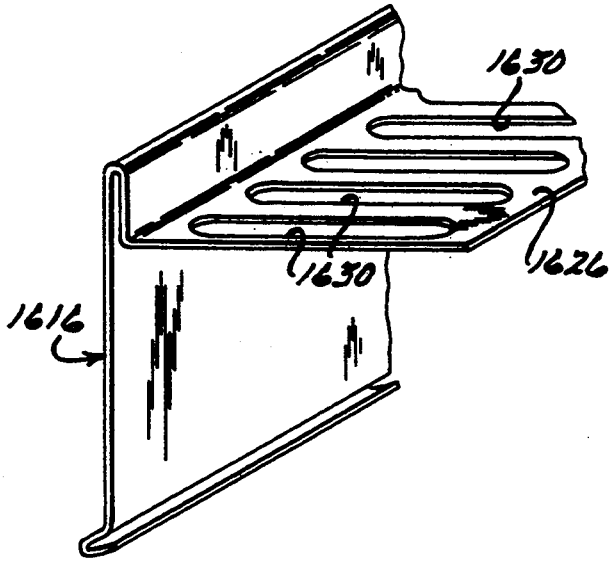
Figure 17:
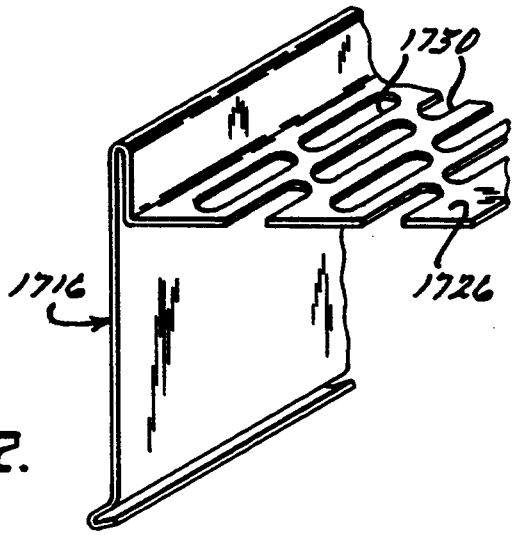
Figure 18:
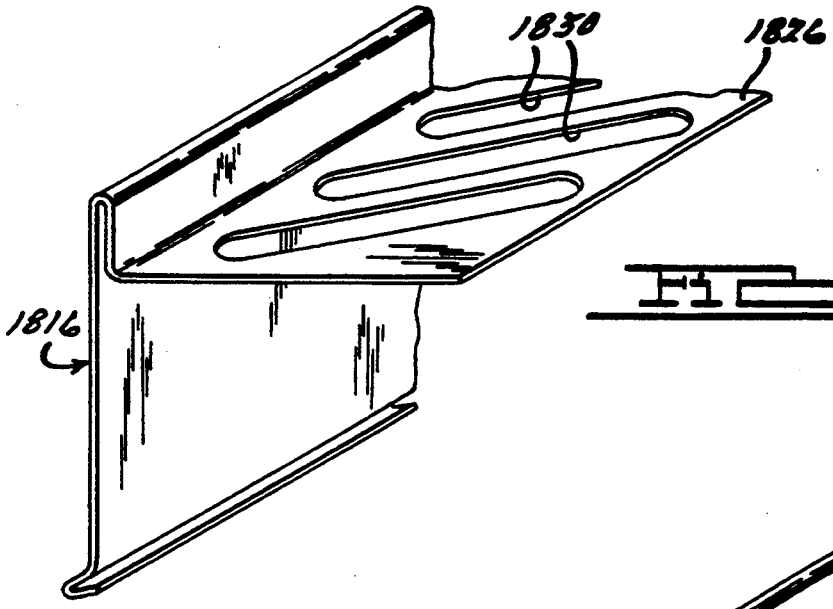
Figure 19:
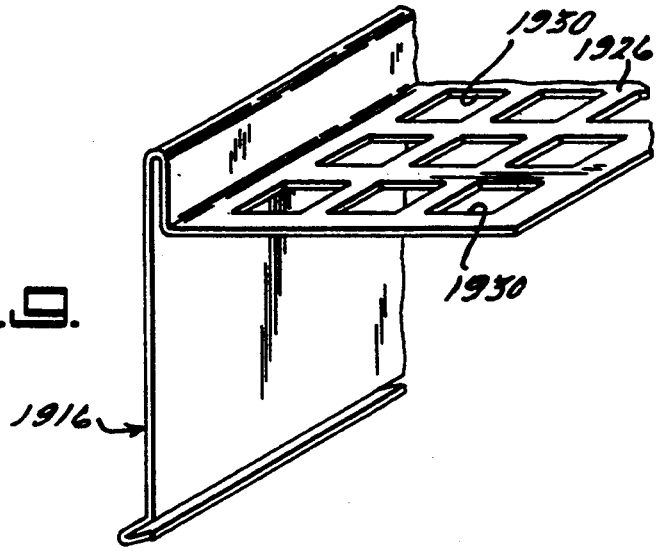

FIG. 10 illustrates a modified anchoring member 1016, having a generally horizontal lip portion 1034, rather than a raised upper portion, as was present in previous figures. FIGS. 11 and twelve, respectively, also depict the anchoring member 1016, but show the configuration for making outside and inside mitered corners, respectively, with adjacent corner portions being interlockingly interconnected by tabs 1042 and 1043, respectively.

In FIG. 13, another variation is shown, wherein the anchor member 1316 is substantially similar to the anchor member 16 of FIGS. 1 through 3, but a joint cover 1350 is provided to fill any gaps due to installation or thermal contraction between adjacent anchor members 1316. Both the joint cover 1350 and the anchor member 1326 engage a substantially continuous clip member 1352, secured to the roof structure 1314, and running along the edge thereof. In effect, this assembly eliminates the need for a separate fascia and the attendant costs and installation operations associated therewith.

FIGS. 14 through 19 merely illustrate some of the many sizes, shapes, arrangements, configurations, and layout patterns that are possible for the openings 1430 through 1930, respectively, in the anchoring flanges 1426 through 1926, respectively. Any of these examples shown can, of course, be used in conjunction with any of the embodiments of the invention, and still others will, of course, occur to those skilled in the art.

Figure 20:
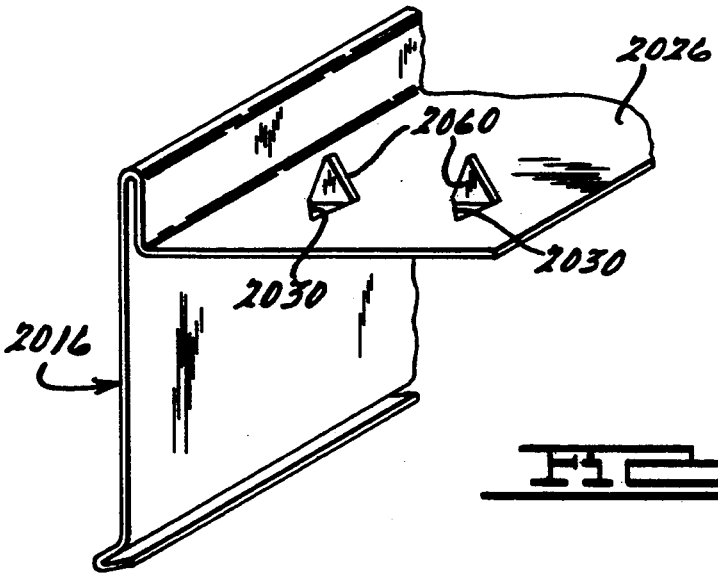
FIG. 20 is a view similar to those of FIGS. 14 through 19, but illustrating a perforated anchoring flange with gripping protrusions being formed at or adjacent to the perforations or openings in the anchoring flange.

Finally, FIG. 20 illustrates the provision of a gripping protuberance 2060 adjacent the openings 2030, in order to better grip and restrain the roofing material in applications where such increased gripping effect is warranted. These protrusions or protuberances 2060 can be formed as part of the forming of the openings 2030, as by punching, or in other ways well-recognizable to those skilled in the art. Also, although these protuberances are shown as pointed in FIG. 20, they can be of virtually any shape that contributes the desired gripping effect on the roofing material with which they will be employed, and they can be used in any of the embodiments of the invention.

The foregoing discussion discloses and describes exemplary embodiments of the present invention. One skilled in the art will readily recognize from such discussion, and from the accompanying drawings and claims, that various changes, modifications, and variations can be made therein without departing from the spirit and scope of the invention as defined in the following claims.

We claim:

1. A roof component assembly for sealingly anchoring a sheet-type base roofing material on a building roof structure, said assembly comprising:

an anchoring flange extending over a portion of said base roofing material, said anchoring flange being secured to the roof structure and having a number of openings extending therethrough;

a marginal strip of roofing material overlapping at least a portion of said openings in said anchoring flange and overlapping a portion of said base roofing material; and heat-welding means for fusing said marginal strip directly to said base roofing material, by heat-welding through said openings in said anchoring flange such that said roofing material under said openings integrally fuses with said marginal strip.

2. An assembly according to claim 1, further including means for integrally fusing said marginal strip directly to said base roofing material at a location interior of said anchoring flange.

3. An assembly according to claim 2, wherein said anchoring member further includes a fascia thereon.

4. An assembly according to claim 3, wherein said fascia is integral with said anchoring member.

5. An assembly according to claim 1, wherein said assembly includes at least a pair of said anchor members and a joint cover overlapping a joint between a pair of longitudinally-adjacent anchor members.

6. An assembly according to claim 1, wherein said openings are round.

7. An assembly according to claim 1, wherein said openings are elongated.

8. An assembly according to claim 1, wherein said openings are rectangular.

9. An assembly according to claim 1, wherein said marginal strip is bonded to said base roofing material by an adhesive.

10. An assembly according to claim 1, wherein said marginal strip is bonded to said base roofing material by heat-welding.

11. A roof component assembly for sealingly anchoring a sheet-type base roofing material on a building roof structure, said assembly comprising:

an anchoring flange extending over a portion of said base roofing material, said anchoring flange being secured to the roof structure and having a number of openings extending therethrough;

a marginal strip overlapping at least a portion of said openings in said anchoring flange and overlapping a portion of said base roofing material; and heat-welding means for fusing said marginal strip directly to said base roofing material by heat-welding through said openings in said anchoring flange and at a location interior of said anchoring flange such that said roofing material under said openings and at said interior location integrally fuses with said marginal strip.

12. An assembly according to claim 11, wherein said anchoring member further includes a fascia thereon.

13. An assembly according to claim 12, wherein said fascia is integral with said anchoring member.

14. An assembly according to claim 11, wherein said assembly includes at least a pair of said anchor members and a joint cover overlapping a joint between a pair of longitudinally-adjacent anchor members.

15. An assembly according to claim 11, wherein said openings are round.

16. An assembly according to claim 11, wherein said openings are elongated.

17. An assembly according to claim 11, wherein said openings are rectangular.

18. An assembly according to claim 11, wherein said marginal strip is bonded to said base roofing material by an adhesive.

19. An assembly according to claim 11, wherein said marginal strip is bonded to said base roofing material by heat-welding.

20. A roof component assembly for sealingly anchoring a sheet-type base roofing material on a building roof structure, said assembly comprising:

an anchoring flange extending over a portion of said base roofing material, said anchoring flange being secured to the roof structure and having a number of openings extending therethrough;

a marginal strip overlapping at least a portion of said openings in said anchoring flange and overlapping a portion of said base roofing material; and solvent-welding means for fusing said marginal strip directly to said base roofing material by solvent-welding through said openings in said anchoring flange such that said roofing material under said openings integrally fuses with said marginal strip.

21. A roof component assembly for sealingly anchoring a sheet-type base roofing material on a building roof structure, said assembly comprising:

an anchoring flange extending over a portion of said base roofing material, said anchoring flange being secured to the roof structure and having a number of openings extending therethrough;

a marginal strip overlapping at least a portion of said openings in said anchoring flange and overlapping a portion of said base roofing material; and solvent-welding means for fusing said marginal strip directly to said base roofing material by solvent-welding through said openings in said anchoring flange and at a location interior of said anchoring flange such that said roofing material under said openings and at said interior location integrally fuses with said marginal strip.

* * * * *

UNITED STATES PATENT AND TRADEMARK OFFICE

CERTIFICATE OF CORRECTION

PATENT NO. : 5,414,965

DATED : May 16, 1995

INVENTOR(S) : Kelley, et al

It is certified that error appears in the above-indentified patent and that said Letters Patent is hereby corrected as shown below:

On the Title Page under Attorney, Agent, or Firm, Harness, Dickey & Pierce" should be --Harness, Dickey & Pierce, P.L.C.--.

Abstract, lines 4, 5, "marshal" should be --marginal--.

Abstract, line 5, "martial" should be --material--.

Abstract, line 8, "an" should be --can--.

Abstract, line 11, "conjurations" should be --configurations--.

Signed and Sealed this

Twelfth Day of September, 1995

*Attest:*

Bruce Lehman

BRUCE LEHMAN

*Attesting Officer*

*Commissioner of Patents and Trademarks*